US007016834B1

(12) United States Patent
Lakaniemi

(10) Patent No.: US 7,016,834 B1
(45) Date of Patent: Mar. 21, 2006

(54) METHOD FOR DECREASING THE PROCESSING CAPACITY REQUIRED BY SPEECH ENCODING AND A NETWORK ELEMENT

(75) Inventor: Ari Lakaniemi, Tampere (FI)

(73) Assignee: Nokia Corporation, Espoo (FI)

( * ) Notice: Subject to any disclaimer, the term of this patent is extended or adjusted under 35 U.S.C. 154(b) by 673 days.

(21) Appl. No.: 10/030,667

(22) PCT Filed: Jul. 14, 2000

(86) PCT No.: PCT/FI00/00647

§ 371 (c)(1),
(2), (4) Date: Jun. 5, 2002

(87) PCT Pub. No.: WO01/08136

PCT Pub. Date: Feb. 1, 2001

(51) Int. Cl.
*G10L 11/06* (2006.01)

(52) U.S. Cl. ..... 704/214; 704/215

(58) Field of Classification Search ..... 704/214, 704/205, 212, 215; 370/287; 455/439
See application file for complete search history.

(56) References Cited

U.S. PATENT DOCUMENTS

| | | | | |
|---|---|---|---|---|
| 5,483,619 | A | 1/1996 | Blanchard | 395/2.87 |
| 5,555,546 | A | 9/1996 | Matsumoto | 315/244 |
| 5,867,574 | A | 2/1999 | Eryilmaz | 379/389 |
| 6,542,501 | B1 * | 4/2003 | Tikka | 370/389 |
| 2004/0062274 | A1 * | 4/2004 | Hakansson et al. | 370/468 |

FOREIGN PATENT DOCUMENTS

| | | | |
|---|---|---|---|
| EP | 0 843 301 A2 | 5/1998 | |
| FI | WO 96/32823 | * 10/1996 | |
| WO | WO 96/42142 | 12/1996 | |
| WO | WO 99/40569 | 8/1999 | |

* cited by examiner

*Primary Examiner*—Richemond Dorvil
*Assistant Examiner*—V. Paul Harper
(74) *Attorney, Agent, or Firm*—Cohen, Pontani, Lieberman & Pavane

(57) ABSTRACT

In general, this invention concerns speech encoding and decoding used in digital radio systems and a method by which the processing capacity required can be reduced in a telecommunication system using discontinuous transmission between a transmitter and receiver. In particular, the method according to the invention is used to match two telecommunication systems using different encoding methods between the transmitter and receiver. In the method, the signals transmitted by the transmitter are made suitable for the receiver in the signal path so that in the first step, at least one information parameter comprising at least two content identifiers is formed for each data frame of the data parameters (101) received. In the next step, data corresponding to the original data is synthesized from the data parameters (101) of the received frames, after which the synthesized data is transmitted for recoding with an encoding method suitable for the receiver. In the final step, during recoding, at least some data parameters (107) of the frames are updated on the basis of at least one value of said content identifiers of the information parameter, and the frames to be transmitted to the receiver are selected from all the recoded data frames on the basis of the value of at least one other content identifier of the information parameter. In addition, the invention concerns a network element, which is arranged to implement the method described above.

6 Claims, 4 Drawing Sheets

METHOD FOR DECREASING THE PROCESSING CAPACITY REQUIRED BY SPEECH ENCODING AND A NETWORK ELEMENT

PRIORITY CLAIM

This is a U.S. national stage of PCT application No. PCT/FI00/00647, filed on Jul. 14, 2000. Priority is claimed on that application and on Application No. 991605, filed in Finland on Jul. 14, 1999.

FIELD OF THE INVENTION

In general, this invention relates to speech encoding and decoding used in digital radio systems and particularly a method by which the processing capacity required can be reduced in a telecommunication system using discontinuous transmission between a transmitter and a receiver.

BACKGROUND OF THE INVENTION

In the arrangement used in modern speech encoding techniques, speech codecs process the speech signal in periods, which are called speech frames or just frames. Here the term codec means the arrangement by which speech can be encoded. Preferably it comprises an encoding algorithm and means for implementing it on a speech signal. A typical frame length of a speech codec is 20 ms, which corresponds to 160 samples at a sampling frequency of 8 kHz. The speech frames generally vary from 10 ms to 30 ms. Each speech frame is processed in a speech encoder, and certain encoding parameters are formed of these frames and transmitted to the decoder. The decoder forms a synthesized speech signal by means of those parameters.

In digital cellular radiotelephony systems, such as the GSM (Global System for Mobile communications), a discontinuous transmission method (DTX, Discontinuous Transmission), which is also defined in many speech encoding standards, is generally used. The discontinuous transmission method generally means that the transmitter part of the terminal is switched off for most of the time when the user does not speak i.e., when the terminal has nothing to transmit. The purpose of this is to reduce the average power consumption of the terminal and to improve the utilization of radio frequencies, because transmitting a signal, which carries just silence, causes unnecessary interference with other simultaneous radio connections. According to some research, only 40% of the data transmitted contains actual speech data. The rest is silence or background noise. Thus a discontinuous transmission method, in which frames that do not contain actual speech are removed, provides many advantages. Firstly, the processing load of the encoder can be reduced, because the "redundant" frames are not encoded at all. Secondly, when the number of frames to be transmitted is reduced, the power consumption of the device is also reduced. Furthermore, the loading of the network can be reduced, when "redundant" frames are removed from the data to be transmitted.

An operation called Voice Activity Detection (VAD) is used for speech detection in a discontinuous transmission method. The voice activity detection takes place e.g. so that a voice activity detector is arranged to examine each frame to be transmitted, and on the basis of the examination it is concluded whether the frame contains speech data or not. The operation of the voice activity detector is based on its internal variables, and the output of the detector is preferably one bit, which is called the VAD flag. Value 1 of the VAD flag then corresponds to a situation where there is speech to be processed, and value 0 a situation where the user is silent. Thus when the flag is up, the frame contains speech data and it can be transmitted. Correspondingly, when the VAD flag is down, the frame can be entirely removed.

The discontinuous transmission method has one disadvantage. When the transmission is interrupted, the background noise that exists in the frames that contain speech, also disappears. This may cause a very unpleasant effect at the receiving end. In a discontinuous transmission method, the interruption of the transmission may take place quickly and at irregular intervals, whereby the receiver experiences the quickly changing voice level as disturbing. Especially when the level of the background noise is high, the interruption of the transmission may even make it more difficult to understand the speech. Therefore it is advantageous to produce in the receiver some synthetic noise, which resembles the background noise of the transmitter and which is called Comfort Noise (CN), even when no frames are transmitted to the receiving end.

The production of comfort noise takes place e.g. so that at first the level of the actual background noise is estimated by means of some frames that contain background noise when the value of the VAD flag changes from one to zero. The element that decides about the discontinuous transmission mode transmits these few frames to the receiver as speech frames. This period when the speech burst has ended, but the transmission of speech frames has not yet been switched off, is called a hangover period. The frames that are transmitted during the hangover period, only contain data caused by background noise, whereby the parameters of the comfort noise can be safely determined by means of these frames. A Silence Descriptor (SID) frame is advantageously used for transmitting the comfort noise parameters to the receiver. The values of the parameters of the SID frames are updated regularly, and at least when the level of the background noise changes. In practice, the SID frame can be used in at least the following two ways. Firstly, a SID frame is transmitted immediately after the hangover period. After this, SID frames are transmitted regularly. An arrangement like this is used in the speech codecs of the GSM system, for example. Another possibility is to transmit a SID frame immediately after the hangover period, but to transmit the next SID frame only when the encoder detects a change in the characteristics of the background noise.

In an ideal situation, both the transmitting terminal and the receiving terminal use the same speech encoding method. In a case like this, the encoded speech need not be changed suitable for some other encoding method. However, in practice this is often necessary. In a situation like this, the encoded speech data is encoded differently by means of a transcoder. The transcoder can be located at any point of the signal path between the transmitter and the receiver.

The prior art transcoders are typically implemented in a manner shown in FIG. 1. The input of the transcoder consists of the input parameters 101 transmitted by the transmitter. The discontinuous transmission reception block 102 of the transcoder has been arranged to estimate whether the parameters received contain speech or comfort noise. Information about the contents of the frame is transmitted to the speech encoder 104 by means of the SP (Speech Present) flag 103, for example. In addition, the frame is also transmitted to the speech decoder 104. The decoding method of the frame depends on the value of the SP flag 103. After decoding, the synthesized speech or comfort noise is transferred to the internal buffer circuit 105 of the transcoder. The recoding of the contents of the buffer circuit 105 is started when the buffer circuit 105 contains a sufficient amount of data. When data is recoded, the voice activity detector 106 is used at first to examine whether the frame contains speech or background noise. On the basis of the quality of the data contained by the frame, the voice activity detector 106 forms a VAD flag 107 and gives it a value. In addition, it transmits the value of the VAD flag 107 and the frame that arrived to it as such forward to the speech encoder 108. The value of the VAD flag 107 is also given to the transmitter unit 110 of the transcoder. The speech encoder 108 processes the data coming to it and transmits the parameters 109 of the encoded data to the transmitter unit 110. The transmitter unit 110 checks on the basis of the values of the VAD flags 107 it received which frames are to be transmitted to the network and which not. In order to make the receiver block of the terminal receiving the signal also to maintain the generation of comfort noise, some frames containing comfort noise can also be transmitted to the receiver, and the parameters of these frames containing comfort noise have been updated in the speech encoder 108, when required.

The problem in the prior art solutions is the fact that the voice activity detector is used twice. For the first time it is used in the encoder circuit of the transmitting terminal and then again in the transcoder. In practice, this means that unnecessary computation procedures are carried out when speech data is transmitted, because in prior art solutions the same voice activity detection procedure is performed twice on the same data flow.

SUMMARY OF THE INVENTION

It is an objective of this invention to eliminate the above mentioned problem of the prior art.

The objectives of the invention are achieved by implementing a transcoder arrangement, by means of which the quality of the contents of the frame can be checked in a simple manner, whereby excessive use of processing capacity is avoided.

The method according to the invention for matching two different encoding methods in a telecommunication system using a discontinuous transmission method between the transmitter and receiver is characterized in that in the signal path the signals transmitted by the transmitter are made suitable for the receiver so that

- for a data frame, at least one information parameter containing at least two content identifiers is formed of the data parameters received,
- data corresponding to the original data is synthesized from the data parameters of the received frames,
- the synthesized data is transmitted for recoding with an encoding method suitable for the receiver,
- during recoding, at least some data parameters of the frames are updated on the basis of at least one value of the content identifiers and
- on the basis of the value of at least one other content identifier, the frames to be transmitted to the receiver are selected from all recoded data frames.

The network element according to the invention, which is arranged to match two different encoding methods in a telecommunication system using a discontinuous transmission method between the transmitter and receiver is characterized in that in the signal path the signals transmitted by the transmitter are arranged to be made suitable for the receiver by a network element, which comprises

- means by which at least one information parameter containing at least two content identifiers is formed for a data frame of the data parameters received,
- means by which synthesized data corresponding to the original contents of the data is formed of the data parameters of the received frames,
- means for recoding the synthesized data with an encoding method suitable for the receiver,
- means for updating the data parameters of at least some frames on the basis of at least one value of the content identifiers and
- means for selecting the frames to be transmitted to the receiver on the basis of at least one other value of the content identifiers from all the recoded data frames.

Preferred embodiments of the invention are described in the dependent claims.

According to the invention, the procedure for carrying out voice activity detection is removed from the signal path, preferably from the transcoder. By an arrangement like this, the structure of the transcoder can be simplified and processing capacity can be saved for other purposes. Information about the contents of the frames is preferably transmitted by means of at least one information parameter, which comprises at least two different content identifiers, to the element which makes the decision about the frames to be transmitted forward.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following, the invention will be described in more detail with reference to the accompanying drawings, in which.

DETAILED DESCRIPTION OF THE PRESENTLY PREFERRED EMBODIMENTS

Figure 1:
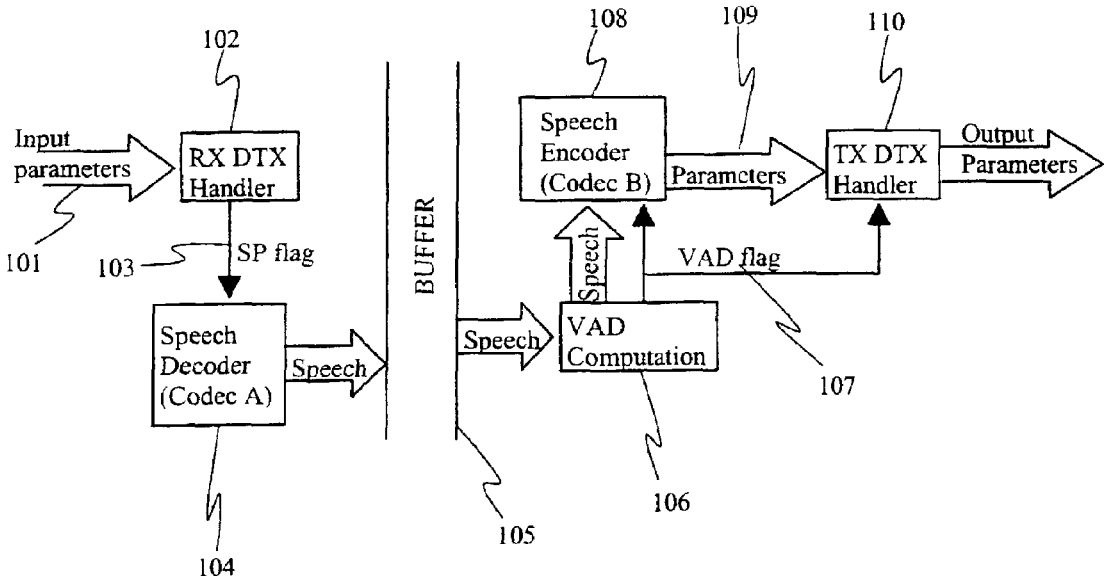
Fig. 1 PRIOR ART
FIG. 1 is a block diagram of a prior art transcoder.

In the figures, the same reference numbers and markings are used for corresponding parts. FIG. 1 was discussed above in connection with the description of the prior art.

Figure 2:
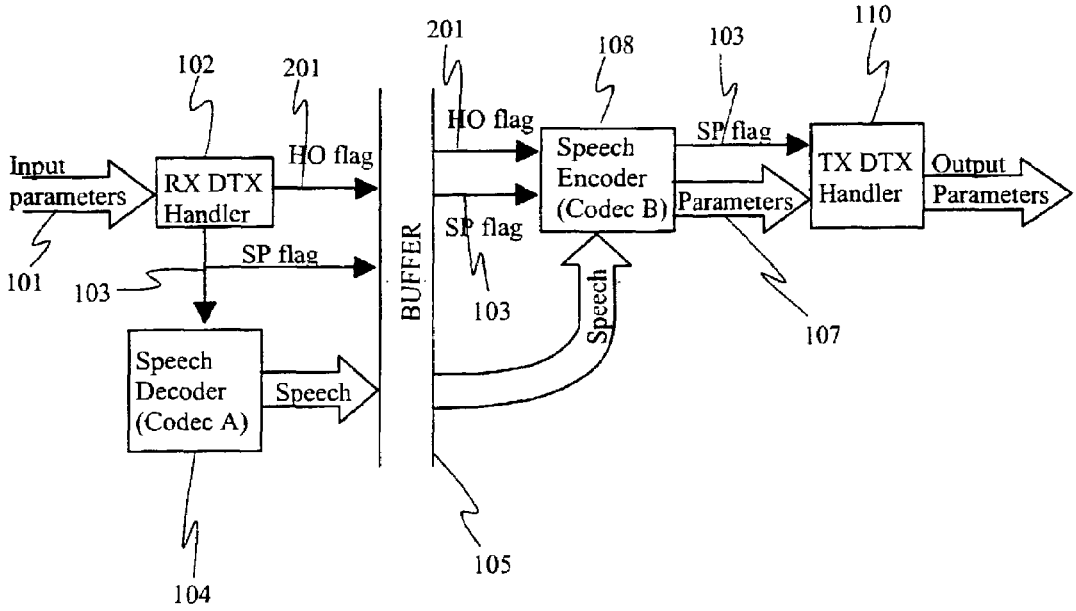
FIG. 2 shows a transcoder according to one embodiment of the invention.

FIG. 2 shows a preferred embodiment of a transcoder according to the invention. The transcoder receives as its input the parameters 101 formed of the speech signal at the transmitting end. The reception block 102 of the transcoder processes the received data and forms an SP flag 103 thereof. The SP flag 103 indicates whether the received frame contains speech data or comfort noise. Here speech data is thus either an actual speech signal or background noise. For example, when the value of the SP flag 103 is 1, the frame contains speech data or background noise, and when the value of the SP flag 103 is 0, the frame contains comfort noise. A frame containing comfort noise is called a SID frame here according to the above description. In addition to the SP flag 103, the reception block 102 determines the HO flag 201 from the received frames. The HO flag 201 can be given the value 1, if the frame is the first one after the hangover period, otherwise the value is 0. It is clear to a person skilled in the art that the HO flag indicates that background noise has been transmitted in the transmission during the hangover period, by means of which background noise the parameters contained by the SID frames can be updated. The SP flag 103 and the HO flag 201 are preferably transmitted to the buffer circuit 105. The value of the SP flag 103 of a certain frame is also transmitted to the decoder 104 together with the data parameters contained by the frame. The decoder 104 is arranged to decode the data parameters of the frame that arrived to it into synthesized speech data and to transmit the synthesized speech frame or comfort noise frame to the internal buffer circuit 105. The decoding method used by the decoder 104 is preferably dependent on the value of the SP flag 103. The speech encoder 108 after the buffer circuit 105 is arranged to read the HO flag 201, SP flag 103 and the synthesized data frame related to them, which are in the buffer circuit 105. The speech encoder 108 starts the recoding of the data e.g. in a corresponding manner as in the prior art solutions, i.e. when adequate data has been fed to the buffer circuit 105. The speech encoder 108 can also update the data parameters of the comfort noise contained by the SID frames. The speech encoder 108 transmits the parameters 107 formed of the data and the SP flag 103 to the transmitter unit 110. The transmitter unit 110 checks the value of the SP flag 103 of each frame and transmits forward at least the parameters of the frames which contain speech data. Preferably, in addition to these frames, some frames which contain comfort noise parameters are transmitted to the receiver so that the receiver can use them to minimize unpleasant reception effects. It is clear to a person skilled in the art that the decoder 104 and the encoder 108 can be arranged to use different codecs.

It has been described above that the two flags, the SP flag 103 and the HO flag 201 are separate content identifiers, which can be used to indicate the type of data contained by each frame, for example. It is clear to a person skilled in the art that the information contained by the content identifiers can also be gathered under one parameter. A parameter like this may be called an information parameter, for example, and it may be a hexadecimal number or the like. In the information parameter arrangement, the first bit of the value of the parameter, for example, indicates the value of the SP flag 103 and the second bit the value of the HO flag 201, and the values of these bits can be changed independently of each other. The information parameter can thus have one value, and the values of different content identifiers can be found out by examining different parts of the value. It is also clear to a person skilled in the art that values of other corresponding flags can also be included in the information parameter when required, which values may be needed for other purposes in speech encoding, for example. The information parameter can belong to any number system or the like, which is suitable for the above mentioned purpose.

Figure 3A:
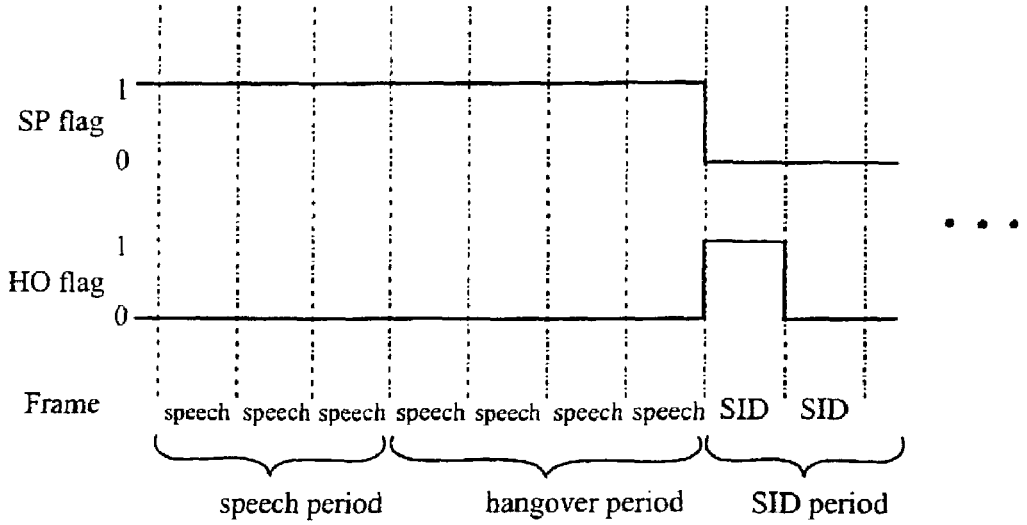
FIGS. 3*a* and 3*b* show some possibilities of using the flag bits of a transcoder according to the invention to indicate the contents of the frames.

FIG. 3*a* shows in the form of a timing diagram the modes of the content identifiers used in the invention, i.e. the SP flag 103 and the HO flag 201, depending on the contents of the frame. In the exemplary embodiment shown here, the first three frames contain speech data, whereby the value of the SP flag 103 is 1. In this embodiment, these frames are followed by a hangover period, which lasts for four frames altogether, and also then the value of the SP flag 103 is 1. During the hangover period, the transmission has not yet been interrupted, although the speech burst has ended Background noise is advantageously transmitted in the frames, by means of which possible new parameters can be defined for the comfort noise formed of the background noise. It is clear to a person skilled in the art that the HG flag 201 can be advantageously used to define for the speech encoder 108 when there is a hangover period after the frames that contain actual speech data. The frames that belong to this hangover period contain background noise, and on the basis of the information contained by these frames, the comfort noise parameters of the SID frames can be updated. During the transmission of the SID frames, the values of the SP flag 103 and the HO flag 201 are zero. It is clear to a person skilled in the art that when frames that contain some data, such as speech or background noise, come to the signal to be transmitted, the flags rise to the correct values according to the description above.

Figure 3B:
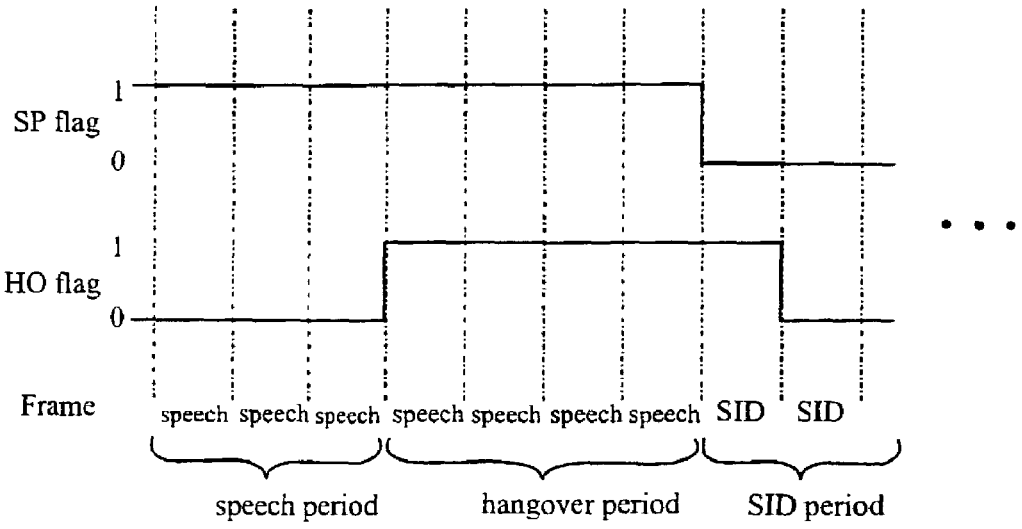

FIG. 3*b* shows a timing diagram of another arrangement according to the invention, in which the modes of the SP flag 103 and the HO flag 201 are arranged to be settled differently than in the case of FIG. 3*a*. In this exemplary case, the first three frames contain speech data, whereby the value of the SP flag 103 is 1. In this embodiment, these frames are followed by a hangover period, which lasts for four frames altogether, and also then the value of the SP flag 103 is 1. During the hangover period, the transmission has not yet been interrupted, although the speech burst has ended. Background noise is advantageously transmitted in the frames, by means of which possible new parameters can be defined for the comfort noise formed of the background noise. In this exemplary embodiment, the HO flag 201 is arranged to rise when the first frame of the hangover period has its turn of transmission. The identification of the first frame of the hangover period can be arranged in the receiver block 102, for example. In this exemplary embodiment the HO flag 201 is also arranged to be kept up until the first SID frame after the hangover period. It is clear to a person skilled in the art that the modes of the flags mentioned above can be arranged such that they are best suited for each application in which the flags are used.

The arrangement discussed above provides clear advantages as compared to the prior art solutions. Generally it is obvious that the algorithms used for voice activity detection are often very complicated and thus very heavy to perform. By skipping one extra voice activity detection, signal processing as a whole can be simplified and processing capacity can be saved for other operations. The arrangement according to the invention is particularly advantageous in a situation where more than one transcoders have been integrated in one apparatus. In that case, the total saving of processing capacity may be substantial. According to some tests, in the case of a Full Rate (FR) codec used in the GSM system, for example, the reduction of one determination of voice activity detection has substantially reduced the complexity of processing.

Another advantage provided by the arrangement according to the invention is also related to simpler implementation. Namely, although the voice activity detection is the same with each codec, there may be differences in the way that the voice activity detector is implemented. In prior art arrangements it is possible that the comfort noise produced by a certain codec can be interpreted as speech in the voice activity detector of another codec, in which case the system is unnecessarily loaded. Especially it has to be noted that the codecs often encode frames that are classified as noise or the like in a simpler manner than frames that are classified as speech. Thus if a frame that contains noise is classified as speech, a larger amount of processing capacity is used for this frame, and the process becomes heavier. By leaving the voice activity detection out from the transcoder, problems like this, which result in the use of unnecessarily high processing power, can be avoided.

In the above description of the invention it has been assumed that the frame times in different codecs are the same. The arrangement according to the invention can advantageously also be used in a case where the frame times between different codecs are different. Let us assume, by way of example, that codec A with a frame time of 20 ms, for example, has been used for the data coming to the transcoder. The system to which the data is to be transmitted, uses codec B with a frame time of 30 ms, for example. In an arrangement according to the invention, in a case like this the matching of the frame times can be implemented by, for example, arranging the SP and HO flags at intervals of 10 ms in the data in the buffer circuit 105. Thus, when the data of codec A is changed into data of codec B, the decoder writes two SP and HO flags in the buffer circuit 105 for each frame. Correspondingly, when the speech encoder reads data from the buffer circuit 105, it preferably reads three SP and HO flags per frame, or 30 ms altogether. On the basis of these three pairs of flags, the transcoder classifies the new frame either as speech or noise and gives the SP flag a value based on the classification. At the simplest, the classification may be based on the criterion that if at least two of the SP flags are up, the value of the new SP flag is also 1. It is clear to a person skilled in the art that other possible solutions, such as different combinations of the SP and HO flags can also be used in the classification. If the transcoder operates in the other direction, it is clear that the decoder writes three pairs of flags in the buffer circuit, of which the speech encoder preferably reads two pairs of flags per frame. It is clear to a person skilled in the art that the flags can also be arranged in the data flow with different intervals than those mentioned above. Preferably the interval is such that the intervals of the frames of codec A and codec B are both divisible by the interval.

It is clear to a person skilled in the art that the hangover period, which has an effect on the value of the HO flag, is dependent on the codec. For example, the hangover period of an FR codec of the GSM system is four frames of 20 ms, whereas in the codec presented in the standard ITU-T G.723.1, for example, the hangover period is six frames of 30 ms. With the method according to the invention, possible problems caused by the lengths of different hangover periods can be avoided. For example, if the hangover period of codec A is temporally longer than the hangover period produced by codec B, there are no problems, because the speech encoder can remove the extra portion of the hangover period when required. On the other hand, if the hangover period of codec A is temporally shorter than the hangover period of codec B, the hangover period can be increased in the speech encoder, when required. This can be implemented e.g. by using the same frames containing comfort noise to new frames during the hangover period.

Figure 4:
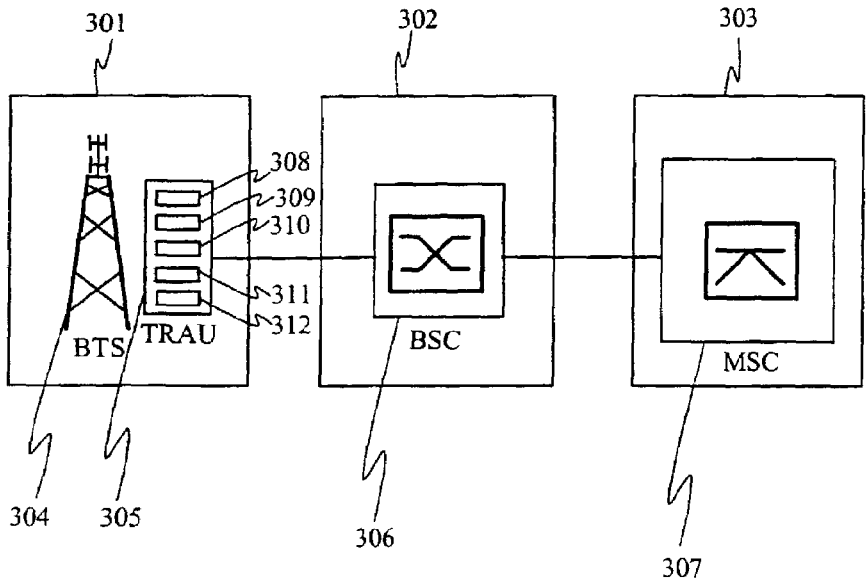
FIG. 4 shows a first network arrangement, in which a transcoder according to the invention is applied.

In the next passage, the application of an arrangement according to the invention in a mobile communication network, such as the GSM network, will be discussed. The transcoder is preferably located between the terminals as connected to a network element. In the GSM network, for example, there has been arranged a separate network element called TRAU (Transcoder/Rate Adaptor Unit). Generally speaking, the task of the TRAU unit is to match networks using different signals. This means, for example, that the signal transfer rates are adapted for the systems. In addition, speech is recoded in the TRAU to make it suitable for transmission to a network using another speech encoding system. FIG. 4 shows the location of a TRAU 305 according to a preferred embodiment of the invention in a mobile communication network. This TRAU 305 comprises means 308 for processing the received speech parameters so that an SP flag can be determined from the parameters to indicate whether the received frame contains speech parameters or comfort noise parameters. In addition, TRAU 305 comprises means 308, by means of which the HO flag can be determined from the received parameters to indicate the first frame after the hangover period. Furthermore, TRAU 305 comprises means 309 for decoding the speech with a codec agreed on in advance, for example. TRAU 305 also comprises means 310, to which the synthesized speech data and the SP and HO flag can be temporarily moved. In addition, TRAU 305 comprises means 311, by which said information can be read from the buffer circuit and according to the information be recoded by some other codec, and by which means 311 the parameters of frames containing comfort noise can be updated, when required. Furthermore, TRAU 305 comprises means 312, to which the parameters of the encoded data and the SP flag can be moved and in which means 312 the frames to be transmitted forward can be selected on the basis of the value of the SP flag, for example. According to a preferred embodiment, TRAU 305 transmits forward only the frames that contain speech data. It is clear to a person skilled in the art that the means presented can be understood as a microprocessor circuit or the like, which implements the operations presented above by means of inputted programs, for example. Preferably the microprocessor is provided with memory, in which the speech data and the values of the flags, for example, can be temporarily saved.

Figure 5:
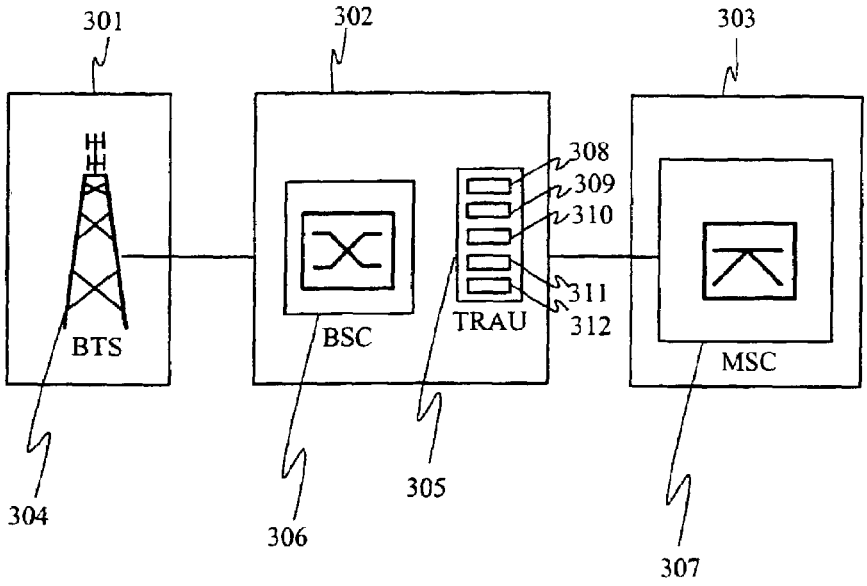
FIG. 5 shows another network arrangement, in which a transcoder according to the invention is applied.
Figure 6:
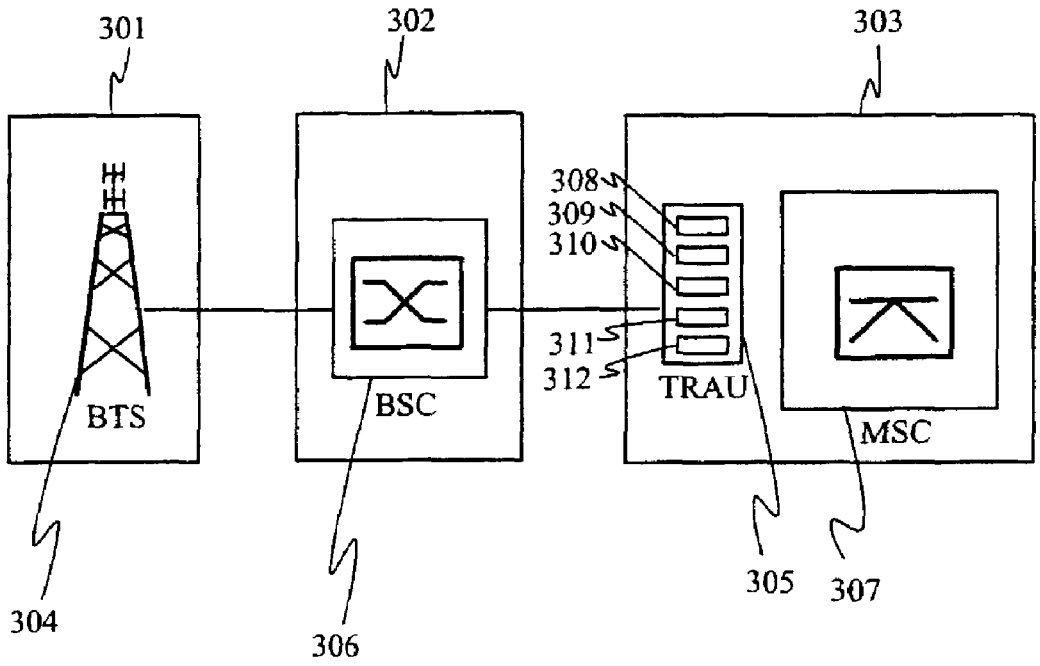
FIG. 6 shows a third network arrangement, in which a transcoder according to the invention is applied.

The TRAU 305 shown in FIG. 4 is located in connection with a Base Transceiver Station (BTS) 304 of the mobile communication network. FIG. 4 also shows a Base Station Controller (BSC) and a Mobile Switching Centre (MSC) of the mobile communication network. It is clear to a person skilled in the art that the network elements are separate operational units, as shown by lines 301, 302 and 303 in FIG. 4. FIG. 5 shows corresponding network elements. In this exemplary embodiment, TRAU 305 is located in the immediate vicinity of the base station controller 306. FIG. 6 shows a third possibility of locating TRAU 305 in connection with the mobile switching centre 307 as a separate operational unit. It is clear to a person skilled in the art that TRAU 305 can also be located in other possible network elements. Network elements of the GSM system have been used as examples in this description when discussing how a transcoder according to the invention can be placed in the network topology. It is clear that a transcoder according to the invention can also be placed in other network elements than TRAU 305 and also in other systems than the GSM to perform corresponding operations as those presented here.

It is clear to a person skilled in the art that the terms used above have been used as examples, and their sole purpose is to clarify the application of a method according to the invention. The arrangement according to the invention can also be used in other systems than the GSM. Particularly advantageously the method presented above is applied in any system which encodes and decodes speech, within the scope defined by the attached claims.

Thus, while there have been shown and described and pointed out fundamental novel features of the present invention as applied to a preferred embodiment thereof, it will be understood that various omissions and substitutions and changes in the form and details of the devices described and illustrated, and in their operation, and of the methods described may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A method for matching two different encoding methods in a telecommunication system using a discontinuous transmission method between the transmitter and receiver, wherein in the signal path the signals transmitted by the transmitter are made suitable for the receiver, the method comprising the steps:

determining for a data frame from data parameters of a received data frame at least one information parameter containing at least first and second content identifiers and transmitting further said at least one information parameter, synthesizing data parameters of said data frame corresponding to original data parameters of the received data frame according to at least said first content identifier, recoding the data parameters of the synthesized data frame with an encoding method suitable for the receiver according to said at least one information parameter, updating, during recoding, the data parameters of at least some of said synthesized data frames based on said at least one information parameter, and selecting data frames from all recoded data frames for transmission to the receiver based on at least said first content identifier.

2. The method of claim 1, wherein said step of updating comprises updating the data parameters of at least some of said synthesized data frames that describe background noise.

3. The method of claim 1, wherein at least said second content identifier of said at least one information parameter comprises information about a first data frame after a hangover period.

4. The method of claim 1, wherein at least said first content identifier of said at least one information parameter comprises information about contents of the data frame.

5. A network element, which is arranged to match two different encoding methods in a telecommunication system using a discontinuous transmission method between the transmitter and receiver, wherein in the signal path the signals transmitted by the transmitter are arranged to be made suitable for the receiver by a network element, which comprises means for determining at least one information parameter containing at least first and second content identifiers for a data frame from data parameters of a received data frame and means for transmitting further said at least one information parameter, means for synthesizing data parameters of said data frame corresponding to original contents of data parameters of the received data frames according to at least said first content identifier, means for recoding the data parameters of the synthesized data frame with an encoding method suitable for the receiver according to said at least one information parameters, means for updating the data parameters of at least some of said synthesized data frames based on said at least one information parameter, and means for selecting data frames from all recoded data frames to be transmitted to the receiver based on at least said first content identifier.

6. The network element of claim 5, wherein the network element is a Transcoder/Rate Adaptor Unit (TRAU).

* * * * *

UNITED STATES PATENT AND TRADEMARK OFFICE

CERTIFICATE OF CORRECTION

PATENT NO. : 7,016,834 B1
APPLICATION NO. : 10/030667
DATED : March 21, 2006
INVENTOR(S) : Ari Lakaniemi It is certified that error appears in the above-identified patent and that said Letters Patent is hereby corrected as shown below:

Please amend cover page to include the following issuing data:

--(30) Foreign Application Priority Data

July 14, 1999 (Fl) 991605--

Signed and Sealed this

Twenty-fifth Day of July, 2006

JON W. DUDAS

*Director of the United States Patent and Trademark Office*